United States Patent [19]

Simcoe et al.

[11] Patent Number: 4,885,443

[45] Date of Patent: Dec. 5, 1989

[54] SEALED BACKLIT SWITCH ASSEMBLY

[75] Inventors: Steven B. Simcoe, Convoy, Ohio; Charles M. Orth; John J. VanDaele, both of Fort Wayne, Ind.

[73] Assignee: Tokheim Corporation, Fort Wayne, Ind.

[21] Appl. No.: 277,302

[22] Filed: Nov. 29, 1988

[51] Int. Cl.[4] ..... H01H 13/06

[52] U.S. Cl. ..... 200/296; 200/344; 200/517; 200/314

[58] Field of Search ..... 200/513, 517, 314, 302.2, 200/296, 344

[56] References Cited

U.S. PATENT DOCUMENTS

| | | | |
|---|---|---|---|
| 2,343,060 | 2/1944 | Horning | 200/5 R |
| 2,562,185 | 7/1951 | Gross | 200/513 |
| 3,663,781 | 5/1972 | Zimmerman et al. | 200/330 |
| 3,735,068 | 5/1973 | Yanaga et al. | 200/512 |
| 4,056,701 | 11/1977 | Weber | 200/314 |
| 4,088,855 | 5/1978 | Emery | 200/16 A |
| 4,117,279 | 9/1978 | Schoemer | 200/5 A |
| 4,121,070 | 10/1978 | Silbernagel | 200/535 |
| 4,360,722 | 11/1982 | Georgopulos | 200/314 |
| 4,463,232 | 7/1984 | Takakuwa | 200/513 |
| 4,471,189 | 9/1984 | Bacon et al. | 200/516 |
| 4,491,702 | 1/1985 | Kato | 200/513 |
| 4,604,509 | 8/1986 | Clancy et al. | 200/513 |
| 4,710,597 | 12/1987 | Loheac | 200/5 A |
| 4,822,963 | 4/1989 | Martin | 200/296 |

*Primary Examiner*—Renee S. Luebke

*Attorney, Agent, or Firm*—Albert L. Jeffers; Anthony Niewyk

[57] ABSTRACT

A sealed backlit switch assembly including an integral body composed of an elastomeric material and having a hollow push button. The body is clamped to a panel by means of a printed circuit board and threaded fasteners whereby the body is sealed to the panel. The printed circuit board has an LED mounted thereon which is enclosed in a hollow push button which forms a part of the unitary molded body and thereby illustrates the push button.

21 Claims, 3 Drawing Sheets

SEALED BACKLIT SWITCH ASSEMBLY

BACKGROUND OF THE INVENTION

This invention relates generally to electrical switch assemblies and more particularly to a sealed elastomeric backlit switch wherein the housing and pushbutton are formed as a unitary elastomeric molding which can be sealingly clamped to a mounting panel.

Push button operated electrical switches, including backlit switches, are widely used in numerous applications. Many of these applications are in environments which are rather benign to electrical switches so that the switches are not exposed to either very high or low temperatures, moisture, potential hard use or even abuse.

In prior art fuel dispensing installations, such as in gasoline service stations, the electrically powered fuel dispenser pump is conventionally actuated by moving a lever which operates an electrical switch located inside a protective housing. Some prior art fuel dispensing installations provide a separate exposed switch assembly which the operator must operate to activate the dispenser. Such switch assemblies, due to the location of the dispenser in an outside environment, must be designed to operate in temperatures in the range of −40° C. to +85° C. and must also be sealed to withstand rain, snow and ice as well as hard use. Some prior art fuel dispensing installations have provided push button switches for activating the dispenser which use a rubber or vinyl boot to seal the switch assembly. Such switches have the disadvantage that the rubber or vinyl boot material is easily ripped or torn thereby exposing the internal switch mechanism to the elements. Still other prior art fuel dispensing installations have been provided wherein a relatively large push button switch assembly is provided for direct actuation of the electrical switch by an operator. These assemblies are quite expensive and also require a substantial amount of space.

A new type of self service fuel dispensing installation has recently come into use whereby the operator may select either a credit card transaction or a cash transaction. For that reason, it has become desirable to provide a lighted push button dispenser actuation switch so that the customer is reminded to depress a switch for either a cash or credit transaction. In certain of these dispensing installations, several push button switches are provided whereby the switch lights will flash to direct the operator's attention to the need to depress one of the switches. It is important, therefore, that the switch assembly be "user friendly" and is easy to operate. For aesthetic reasons, it is also desirable that such actuation switches may be designed to have a low profile so that they do not extend a very great distance from the front panel of the dispenser.

The cost of providing such switches for such types of fuel dispensing installations may be substantial. For instance, in a large dispenser having four pumps each on two sides of a dispensing island, twenty-six (26) such switches would need to be provided for certain types of dispensing installations.

An additional requirement for a push button actuated switch assembly used in a fuel dispensing installation is to provide positive feedback to the operator, that is to say, to provide sufficient positive movement during actuation of the switch so that the operator is aware that the switch has been actuated. In certain prior art switches, the movement for actuation of a switch is so limited that the operator is not aware, due to a lack of positive feedback, that the switch has actually been actuated.

Prior art switches have been provided with elastomeric elements for both sealing purposes and to give the switch a desired "feel". However, none of these prior art push button switches has been satisfactory to withstand the rugged fuel dispensing installation environment. Such prior art sealed switches have also utilized numerous parts, thereby not only adding undesired expense but also causing the switches to be subject to undesired malfunctions and breakdowns.

It is therefore desired to provide an elastomeric backlit switch suitable for use in rugged environments, which is simple in construction, relatively inexpensive to manufacture, and is not subject to failure.

While the invention described hereinafter is suitable for application in fuel dispensing installations, it should be understood that the invention is not limited to such use and may be used in numerous other applications, particularly those applications wherein a relatively simple and inexpensive switch assembly is needed which has a long life, which can withstand a great range of temperatures and which can be sealed from moisture or other harmful substances.

SUMMARY OF THE INVENTION

The switch assembly according to the present invention, in one form thereof, comprises a unitary housing, including a mounting portion and a hollow push button, which is composed of a resilient material. The switch assembly further includes a grommet which is mounted in an aperture of a mounting panel and receives the push button therein in order to guide the push button for substantially axial movement. An insulation member with an LED mounted thereon is adapted to be secured to the mounting panel for clamping the switch mounting portion between the panel and the insulating member to thereby seal the housing to the panel. The LED is disposed inside the hollow push button to backlight the push button. A switch is mounted on the insulating member whereby, when the push button is depressed, the switch is actuated.

The switch assembly according to the present invention, in one form thereof, comprises a unitary resilient housing composed of an elastomeric material. The housing includes a generally planar mounting portion, a hollow push button switch actuator and a web-like portion which connects the push button actuator to the mounting portion. A circuit board having an LED mounted thereon is secured to a mounting panel with the resilient switch housing clamped between the panel and the circuit board to seal the housing to both the circuit board and the panel. The LED is disposed inside the hollow push button. The hollow push button includes a switch actuating ring portion and the circuit board has a ring-shaped switch member mounted thereon, whereby, upon actuation of the push button, the push button actuating ring contacts and actuates the ring-shaped switch member. A grommet is secured in an aperture of a mounting panel for guiding the push button along substantially axial movement.

One advantage of the switch assembly according to the present invention is that it employs few parts and is easy, and therefore relatively inexpensive, to manufacture and assemble.

Another advantage of the switch assembly according to the present invention is that the switch assembly is suitable for use in an environment where it is exposed to a great range of temperatures and to precipitation.

An additional advantage of the switch assembly according to the present invention is that the push button switch actuator moves a substantial distance for actuation of the switch to provide a positive indication to the operator that the switch has been actuated.

A further advantage of the switch assembly according to the present invention is that it has a low profile and therefore is aesthetically pleasing.

Yet another advantage of the switch assembly according to the present invention is that the push button is lighted so that it may be used to give various indications to an operator.

A yet further advantage of the switch assembly according to the present invention is that the push button is axially guided so that it will not rock, hang up, or fail to actuate the switch when the push button is depressed.

The present invention, in one form thereof, comprises a sealed switch assembly for mounting on a panel. The switch assembly includes a unitary resilient housing, the housing including a mounting portion and a moveable hollow button. A grommet is adapted to be mounted in an aperture in the panel for receiving the push button and for guiding the push button along substantially linear movement. An insulating board adapted to have electrical components mounted thereon includes mounting means thereon for securing the insulating board in a predetermined aligned position with respect to the grommet whereby the resilient housing is clamped between the panel and the insulating board and the resilient switch housing is sealed against the panel. A switch is located on the insulating board and is adapted to be actuated by the push button upon operation thereof. A light source is mounted on the insulating board and is disposed inside the hollow push button for illuminating the hollow push button.

The present invention, in one form thereof, comprises a switch assembly for mounting on a panel. The switch assembly includes a unitary resilient housing including a mounting portion, a moveable hollow push button actuator, a flexible web-like portion moveably connects the push button to the mounting portion and a cylindrical hollow space is disposed intermediate the push button and the mounting portion. The push button actuator includes a ring-shaped actuator on one end thereof. An insulating board is adapted to be secured to the panel with the resilient housing clamped between the circuit board and the panel. A sealing ring is integrally formed on the housing for sealing the housing to the panel. A grommet is disposed in the cylindrical hollow space for guiding the push button substantially linearly upon actuation thereof. A switch is mounted on the circuit board and is adapted to be actuated by the ring shaped actuator. A light source is mounted on the insulating circuit board and is disposed inside the hollow push button.

The present invention, in one form thereof, comprises a sealed switch assembly for mounting on a panel. The switch assembly includes a unitary resilient housing including a generally planar mounting portion having a generally cylindrical hollow recess therein. A generally hollow cylindrical push button is disposed in the hollow recess for movement which is generally perpendicular to the plane of the housing. A flexible web interconnects the mounting portion and the push button. A generally planar insulating member is adapted to be secured to the panel to clamp the mounting portion between the panel and the insulating member whereby the housing is sealingly clamped to the panel. A ring-shaped switch is mounted on the insulating member for actuation by an actuator ring portion of the push button. A grommet is secured to the panel for receiving the push button therein and for guiding the push button for substantially linear movement. A light source is mounted on the insulating member inside the push button for illuminating the push button.

It is an object of the present invention to provide a sealed, backlit, elastomeric switch assembly which has few parts and is therefore easy to assemble and of relatively modest cost.

It is another object of the present invention to provide a sealed backlit switch assembly which operates well in an outdoor environment wherein it is subject to a large range of temperatures and to precipitation.

It is still another object of the present invention to provide a switch assembly which provides the proper tactile feel to an operator to positively indicate that the switch has been actuated.

An additional object of the present invention is to provide a low profile switch assembly which is aesthetically pleasing.

Still another object of the present invention is to provide a lighted switch assembly which may be used in self-service fuel dispensing installations to indicate to an operator that a certain operation must be performed.

A still further object of the present invention is to provide an elastomeric sealed switch assembly wherein the push button is guided to eliminate rocking movement of the push button and to ensure proper and dependable actuation of the switch by the push button actuator.

BRIEF DESCRIPTION OF THE DRAWINGS

The above mentioned and other features and objects of this invention and the manner of attaining them will become more apparent and the invention itself will be better understood by reference to the following description of an embodiment of the present invention, taken in conjunction with the accompanying drawings, wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

Figure 4:
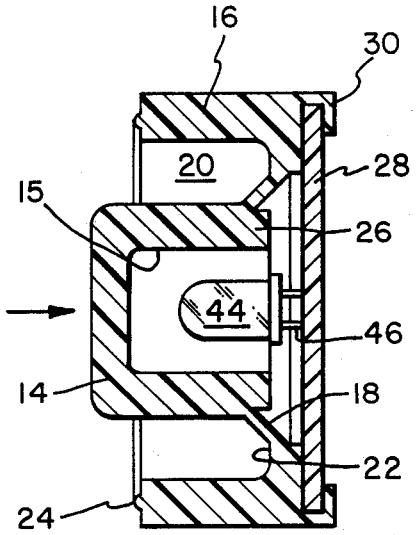
FIG. 4 is a cross sectional view of the switch assembly of FIG. 1 taken along line 4—4 thereof.
Figure 1:
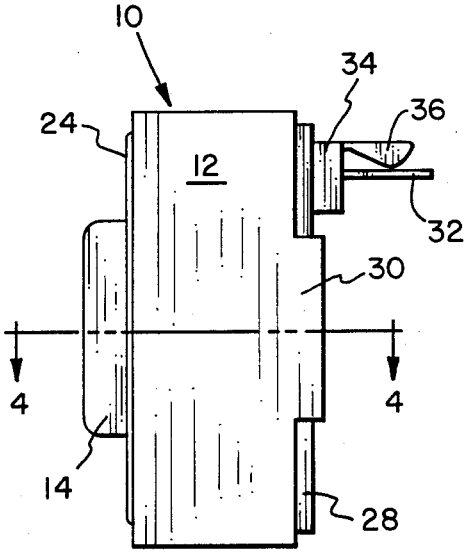
FIG. 1 is an elevational view of the switch assembly according to the present invention.
Figure 2:
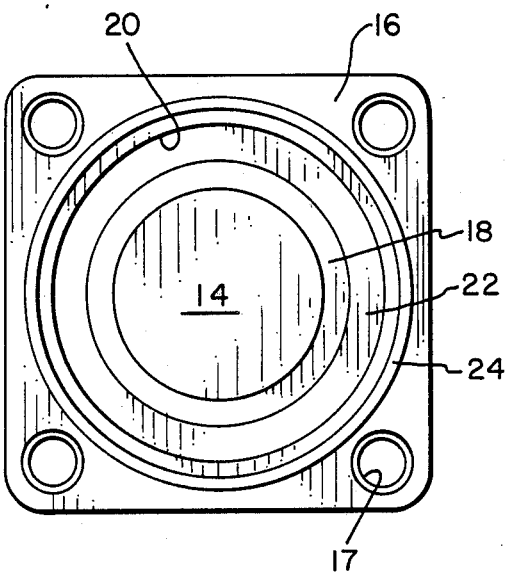
FIG. 2 is a side view of the switch assembly of FIG. 1 taken from the left hand side thereof.
Figure 3:
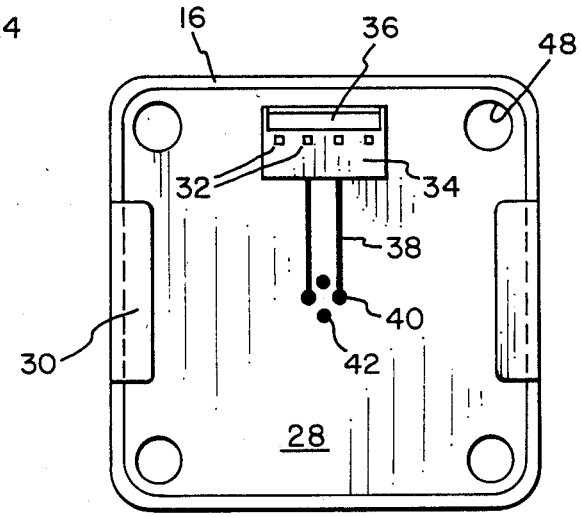
FIG. 3 is a side view of the switch assembly of FIG. 1 taken from the right hand side thereof.

Referring to FIGS. 1–4, there is shown a switch assembly 10 including a unitary elastomeric housing or body 12. The housing includes a push button 14 which is integrally molded with a mounting base 16 and is connected to the mounting base 16 by means of a flexible web 18. The push button is hollow whereby a space 15 will be provided inside push button 14. A hollow space 20 of generally cylindrical shape surrounds push button 14. Push button 14 is therefore axially inwardly moveable into space 20 by flexing movement of web 18, as best seen in FIG. 4, by virtue of the flexibility of web 18. Mounting base 16 includes four apertures 17, as best seen in FIG. 2, for mounting housing 12 on a panel, as further explained hereinafter. Housing 12 is a unitary molding formed of a resilient elastomeric material such as silicone. This material may be molded to provide a resilient housing 12 whereby housing 12 may be sealingly clamped against a panel, whereby push button 14 may be depressed to actuate a switch, and whereby the connecting web 18 generates sufficient restoring force to return the push button 14 to its normal rest position as illustrated in FIG. 4.

Web 18 is connected to the mounting base 16 by means of a thicker portion 22. It can be seen that web 18 forms a frusto-conical portion which then tapers into a thicker portion 22.

A sealing ring 24 is also integrally molded on mounting base 16 for purposes further explained hereinafter. Push button 14 includes an actuating ring portion 26 for actuating a switch as further explained hereinafter. A printed circuit board 28 is captured between two flanges 30 which are integrally molded with housing 12 and retain circuit board 28 during shipment of switch assembly 10. Circuit board 28 is made of conventional printed circuit board insulating material and has connected thereto four contact posts 32 by way of a contact header 34. Contact posts 32 are soldered to islands (not shown) provided on circuit board 28. Contact header 34 is formed of an insulating material, such as plastic material, and includes a contact header lock 36 for locking a connector to contact header 34. A pair of printed circuit board connecting tracks 38 are also provided on circuit board 28. The tracks end in islands 40 to which the leads of an LED are soldered as disclosed hereinafter. A pair of apertures 42 is provided in the circuit board whereby air may escape from space 20 when push button 14 is depressed.

As seen in FIG. 4, LED 44 is soldered to soldering islands 40 by means of its leads 46. Circuit board 28 includes four apertures 48 which are aligned with apertures 17 in mounting base 16 for receiving threaded mounting posts. It can also be seen that circuit board 28 is slightly smaller than the outside circumference of mounting base 16. However, the dimension of the circuit board 28 with respect to mounting base 16 is a matter of design choice.

Figure 5:
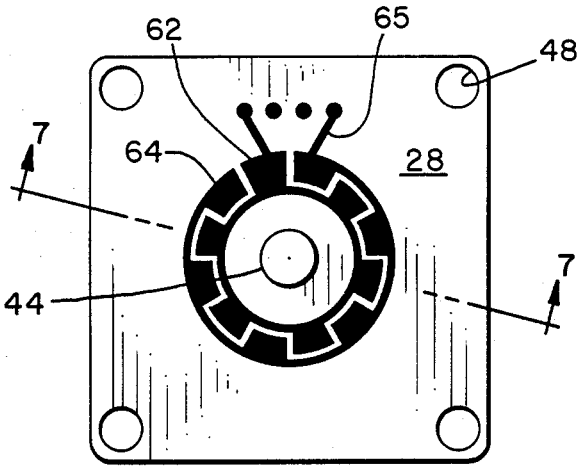
FIG. 5 is a top plan view of the printed circuit board including the membrane switch assembly.
Figure 7:
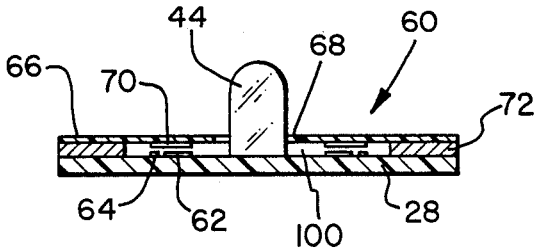
FIG. 7 is a cross sectional view of the printed circuit board and membrane switch assembly of FIG. 5.
Figure 6:
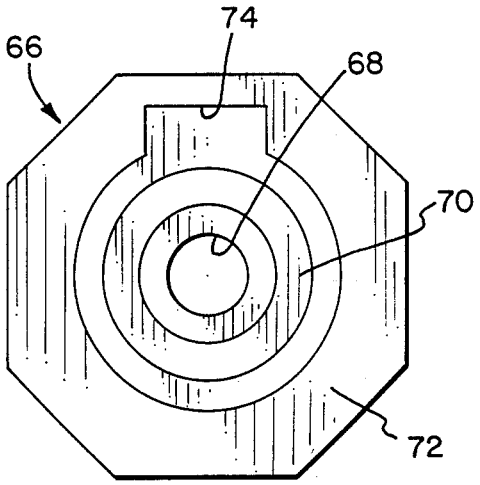
FIG. 6 is a top plan view of the membrane for the membrane switch assembly of FIG. 5.

Referring now to FIGS. 5, 6, and 7, a switch 60 is shown which forms an integral part of circuit board 28. The face of circuit board 28 opposite to contact header 34 is provided with two spaced apart, interlocking contact strips 62 and 64 which are so configured that they form a circle. Tracks 65 connect the contact strips 62, 64 to soldering islands which in turn are connected by two through holes to two contact posts 32. A membrane 66, having a central aperture 68 therein, is mounted over contact strips 62 and 64. Membrane 66 is so configured, as shown in FIG. 6, that it fits within the confines of the printed circuit board and the mounting apertures 48. A ring-shaped metallic layer 70 is deposited on membrane 66 for selectively providing an electrical connection between contact strips 62, 64 and selectively bridging those contact strips to close switch 60. Metallic contact ring 70 is conventionally formed of silver oxide or other suitable conductive material. Membrane 66 is formed of mylar or another insulative material having suitable flexibility so that metallic contact ring 70 is normally out of contact with contact strips 62, 64 as best shown in FIG. 7, but which, upon depression of the push button, will be sufficiently flexed so that the contact strips 62, 64 will be bridged and the switch 60 will be closed. A layer of adhesive material 72 serves to both space the membrane 66 sufficiently far away from printed circuit board 28 and to adhere membrane 66 to printed circuit board 28. It should be noted that the adhesive 72 is applied in a keyhole shaped pattern to avoid contact of the adhesive material with metallic contact ring 70 or tracks 65. Thus, as can be seen in FIG. 7, when the push button actuator ring portion 26 depresses membrane 66, contact strips 62, 64 will be bridged, thereby causing switch 60 to close. Membrane 66, being formed of rather stiff mylar, has sufficient rigidity to return to its rest position as shown in FIG. 7 when the push button actuator ring portion 26 moves out of contact with membrane 66.

Figure 8:
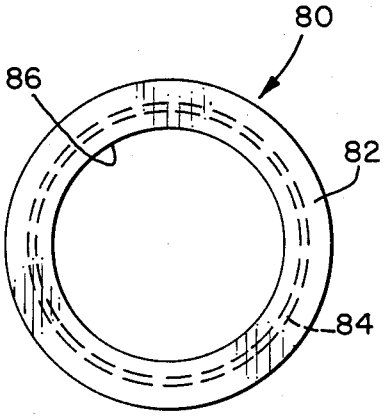
FIG. 8 is an elevational view of the grommet for the switch assembly of FIG. 1.
Figure 9:
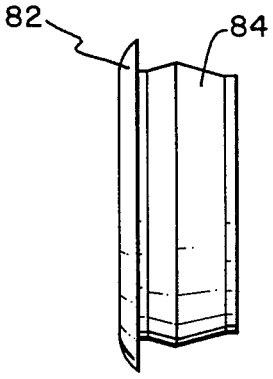
FIG. 9 is a side view of the grommet of FIG. 8.
Figure 10:
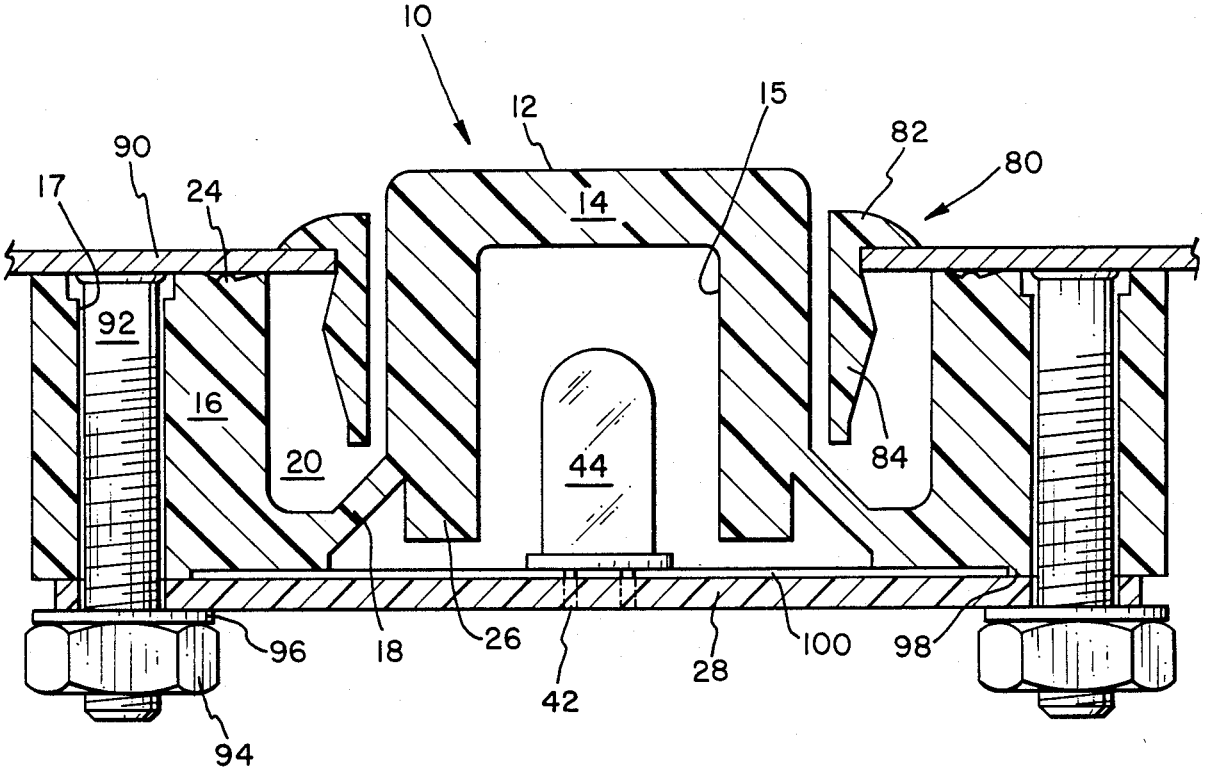
FIG. 10 is an enlarged cross sectional view of the switch assembly mounted on a panel.

Referring now to FIGS. 8 and 9, a grommet 80 is shown which includes a flange or bezel 82, a cylindrical rim 84 and an aperture 86. Rim 84 is configured to fit in space 20 which surrounds push button 14. The material from which the bezel 82 is manufactured may be any suitable material but, in one embodiment, is molded of polypropylene material.

Referring now to the switch assembly 10 shown in FIG. 1, it is seen that the switch assembly is secured to a panel 90. The panel may be the display panel of a fuel dispensing installation. Panel 90 includes an aperture into which grommet 80 is inserted. Housing 12 is so assembled to panel 90 so that cylindrical rim 84 is disposed in space 20. Circuit board 28 is aligned with housing 12 whereby apertures 48 line up with apertures 17. Metallic studs 92 are secured to panel 90 as by brazing and are disposed in apertures 17 and 48. The ends of the studs are threaded for receiving nuts 94. Washers 96 prevent the nuts from working loose. The nuts are tightened on the threaded ends of studs 92 whereby mounting base 16 is compressed between panel 90 and circuit board 28, thus causing sealing engagement of ring 24 with panel 90 to form a tight seal of base 16 with panel 90. If button 14 is exposed to moisture, precipitation may enter into space 20 but it cannot leak past sealing ring 24. Similarly, an upstanding edge 98 of base 16 seals circuit board 28 to mounting base 16. Thus the membrane switch 60 mounted on circuit board 28 is fully protected from contamination by dust or moisture. When the push button 14 is depressed, push button actuator ring 26 will contact the switch membrane 66 and cause the switch 60 to close. Apertures 42 in printed circuit board 28 permit air to escape from the volume enclosed by hollow push button 14, when the push button is depressed.

LED 44 is energized at appropriate times to provide a signal to the operator. Signalling may be accomplished by either intermittent flashing or by constant energization of LED 44. The resiliency of web 18 will cause push button 14 to be returned to its rest position after pressure is removed from push button 14.

It is particularly important to note that grommet 80 guides push button 14 for substantially axial movement so that push button 14 cannot wobble and therefore make insufficient or improper contact with membrane 66. Thus grommet 80 insures that the push button travels in a substantially linear path, when it is depressed, and that push button actuator ring portion 26 contacts membrane 66 in such fashion that contact ring 70 makes proper contact with contact strips 62 and 64.

What has therefore been provided ss a very simple but effective sealed backlit switch assembly, using very few parts but which is very rugged and can operate effectively in the environment of a fuel dispensing installation and other similar environments.

While this invention has been described as having a preferred design, it will be understood that it is capable of further modification. This application is thereby intended to cover any variations, uses, or adaptations of the invention following the general principles thereof and including such departures from the present disclosure as come within known or customary practice in the art to which this invention pertains and fall within the limits of the appended claims.

What is claimed is:

1. A sealed switch assembly for mounting on a panel, said switch assembly comprising:

a unitary resilient housing, said housing including a mounting portion and a movable hollow push button;

a grommet means adapted to be mounted in an aperture in the panel for receiving said push button therein and for guiding said push button for substantially linear movement;

insulating means for mounting electrical components thereon, said insulating means including mounting means for securing said insulating means in a predetermined aligned position with said grommet and for clamping, said resilient housing between said panel and said insulating means whereby said resilient housing is sealed against said panel;

switch means mounted on said insulating means and adapted to be actuated by said push button upon operation thereof; and light source means mounted on said insulation means and disposed inside said hollow push button for illuminating said hollow push button.

2. The switch assembly according to claim 1 wherein the housing includes a flexible web portion for movably connecting said push button to said mounting portion.

3. The switch assembly according to claim 1 including a generally cylindrical open space disposed intermediate said push button and said mounting portion.

4. The switch assembly according to claim 1 wherein said mounting means comprises a first plurality of apertures, said housing including a second plurality of apertures respectively aligned with said first plurality of apertures, said first and second plurality of apertures adapted to receive threaded fasteners for mounting said switch assembly on said panel.

5. The switch assembly according to claim 1 wherein said push button includes a ring shaped actuator for actuating said switch means.

6. The switch assembly according to claim 1 wherein said switch means comprises a membrane switch.

7. The switch assembly according to claim 1 wherein said housing mounting portion includes an integral sealing ring adapted to contact said panel and seal said housing thereto.

8. The switch assembly according to claim 1 wherein said light source means is an LED.

9. The switch assembly according to claim 1 wherein said housing is composed of silicone rubber material.

10. The switch assembly according to claim 1 including an integral flange means on said housing to secure said insulating means to said housing.

11. A sealed switch assembly for mounting on a panel, said switch assembly comprising:

a unitary resilient housing including a mounting portion, a movable hollow push button actuator, a flexible web-like portion movably connecting said push button to said mounting portion, a cylindrical hollow space disposed intermediate said push button and said mounting portion, said push button actuator including a ring shaped actuator on one end thereof;

an insulating circuit board adapted to be secured to the panel with said resilient housing clamped between said circuit board and said panel;

a sealing ring integrally formed on said housing for sealing said housing to said panel;

a grommet disposed in said cylindrical hollow space for guiding said push button substantially linearly upon actuation thereof;

switch means mounted on said circuit board and adapted to be actuated by said ring shaped actuator; and a light source mounted on said insulating circuit board and disposed inside said hollow push button.

12. The switch assembly according to claim 11 wherein said flexible web-like portion is frusto-conically shaped.

13. The switch assembly according to claim 11 wherein said insulating circuit board includes a first plurality of apertures, said housing mounting portion includes a second plurality of apertures respectively aligned with said first plurality of apertures, said first and second plurality of apertures adapted to receive threaded fasteners for mounting said switch assembly on the panel.

14. The switch assembly according to claim 11 wherein said switch means comprises a membrane switch.

15. The switch assembly according to claim 11 wherein said housing is composed of silicone rubber.

16. A sealed switch assembly for mounting on a panel, said switch assembly comprising:

a unitary, resilient housing including a generally planar mounting portion having a generally cylindrical hollow recess therein, a generally hollow cylindrical push button disposed in said hollow recess for generally perpendicular movement to the plane of said housing, and a flexible web interconnecting said mounting portion and said push button;

a generally planar insulating member adapted to be secured to the panel to clamp said mounting portion between said panel and said insulating member, whereby said housing is sealingly clamped to said panel;

a ring-shaped switch mounted on said insulating member for actuation by an actuator ring portion of said push button;

a grommet secured to said panel for receiving said push button therein and for guiding said push button for substantially linear movement; and a light source mounted on said insulating member and disposed inside said push button for illuminating said push button.

17. The switch assembly according to claim 16 wherein said insulating member includes a first plurality of apertures said housing including a second plurality of apertures respectively aligned with said first plurality of apertures, said first and second plurality of apertures adapted to receive threaded fasteners for mounting said switch assembly on the panel.

18. The switch assembly according to claim 16 wherein said switch comprises a membrane switch.

19. The switch assembly according to claim 16 wherein said housing mounting portion includes an integral sealing ring adapted to seal said housing to said panel,

20. The switch assembly according to claim 16 wherein said housing is composed of silicone rubber.

21. The switch assembly according to claim 16 wherein said light source is an LED.

* * * * *